US005862836A

United States Patent [19]

Himmelstoss

[11] Patent Number: 5,862,836

[45] Date of Patent: Jan. 26, 1999

[54] JACQUARD SHED-FORMING DEVICE

[75] Inventor: Michael Himmelstoss, Lyons, France

[73] Assignee: Staubli Lyon, Chassieu, France

[21] Appl. No.: 933,754

[22] Filed: Sep. 23, 1997

[30] Foreign Application Priority Data

Oct. 4, 1996 [FR] France ..... 96 12329

[51] Int. Cl.[6] ..... D03C 3/24; D03C 3/20; D03C 3/00

[52] U.S. Cl. ..... 139/65; 139/455

[58] Field of Search ..... 139/65, 455; 254/337

[56] References Cited

U.S. PATENT DOCUMENTS

| | | | |
|---|---|---|---|
| 4,104,932 | 8/1978 | Hansson . | |
| 5,038,837 | 8/1991 | Palau et al. . | |
| 5,116,364 | 5/1992 | Bassi et al. | 139/65 |
| 5,139,052 | 8/1992 | Derudder | 139/65 |
| 5,373,871 | 12/1994 | Speich | 139/65 |
| 5,671,784 | 9/1997 | Dewispelaere | 139/65 |

FOREIGN PATENT DOCUMENTS

| | | |
|---|---|---|
| 546310 | 4/1956 | Belgium . |
| 0612874 | 1/1994 | European Pat. Off. . |
| 2647473 | 5/1989 | France . |

*Primary Examiner*—Andy Falik
*Attorney, Agent, or Firm*—Dowell & Dowell, P.C.

[57] ABSTRACT

Shed-forming devices for weaving mechanisms which create three positions of the warp threads in a Jacquard loom. The shed-forming devices include moveable spindle catches capable of being vertically displaced by knives driven in oppositely reciprocally oscillating motion. Each shed-forming device includes four moveable spindle catches which are adapted to be displaced in pairs by the knives. A first spindle catch of each pair is adapted to be supported by a second spindle catch of each pair. Each shed-forming device also includes five pulleys which are vertically aligned and are connected to the catches by funicular elements such that the five pulleys may be separated from each other in a variable manner depending upon the position of the four spindle catches.

11 Claims, 2 Drawing Sheets

JACQUARD SHED-FORMING DEVICE

BACKGROUND OF THE INVENTION

1. Field of the Invention

The present invention relates to a weaving mechanism appropriate to create three positions of the warp threads of a Jacquard-type loom and to a Jacquard-type loom provided with such a weaving mechanism.

2. History of the Related Art

A loom comprising a weaving mechanism suitable to create three positions of the warp threads is used for the production of special fabrics, such as velvet or carpeting.

From patent application FR-A-2 647 473 in the name of the applicant is known a weaving mechanism of three positions, comprising two adjacent shed-forming devices, each of which device is provided with two moveable spindle catches. This device is effectual to place the warp threads at three different heights but it occupies a large space because the two sets of moveable spindle catches are arranged side by side, so that the minimum distance between two snap hooks of the extremities of the cords or of the control cables of the loom harness is of the order of 10 mm. Now then, in the case of a weaving mechanism constituted by a large number of cords, e.g., 10,000, the space occupied by a system of the heretofore known state of the art is such, that it is necessary to provide for two shed-forming machines and two adapted driving systems, which would be expensive and would increase the complexity of the machine and therefore the risks of breakdowns.

SUMMARY OF THE INVENTION

The present invention aims at solving these problems and to advance a weaving mechanism suitable to create three positions of the warp threads of a loom, in which the occupied space is roughly the same as that for a weaving mechanism suitable to create two positions and that operates in a reliable and efficient manner.

With this in mind, the invention relates to a weaving mechanism suitable to create three positions of the warp threads of a Jacquard-type loom, the mechanism includes a series of shed-forming devices provided with moveable spindle catches suitable to be vertically moved by knives driven an opposite reciprocally oscillating motion relative to one another. Each shed-forming device is comprised of four moveable spindle catches suitable to be moved in pairs by the hasps, wherein one of the spindle hooks of each pair is supported by the second spindle hook of the pair, and wherein five vertically aligned pulleys can be separated from each other in a variable manner depending on the positions of the mentioned four spindle catches.

Thanks to the invention, the pairs of moveable spindle catches, constituted by two hooks arranged one above the other, occupy a lateral space that is roughly equal to that of the simple moveable spindle catches used in a weaving mechanism suitable to create two positions, so that the total occupied space of the two pairs of spindle catches is not larger than that of the two moveable hooks of a traditional mechanism. The fact that the five pulleys are vertically aligned makes it possible to limit their laterally occupied space and, in particular, to install two shed-forming devices with a separation of about 5 mm. The obtained mechanism is approximately twice as compact as the heretofore known devices.

According to a first advantageous aspect of the present invention, the five pulleys are co-planar. This makes it possible to increase the compactness of the device because the lateral space it occupies is of the same size as the width of the pulleys, whichever their diameter might be.

According to another advantageous aspect of the present invention, each shed-forming device is provided with at least one guide rail traversing the axes of rotation of some pulleys, this rail being supported on an upper pulley and upwardly moveable with it. Owing to this aspect of the present invention, several pulleys are supported one on top of the other in an upwards moveable manner, and their relative displacements allow the attaining of the three studied positions of the shed-forming device.

According to another advantageous aspect of the present invention, a cord, attached at one of its extremities to the frame of the mechanism and provided with a snap hook fastening one or several heddle(s), is arranged in such a manner as to successively encircle three of the pulleys located in the lower portion of the shed-forming device. This arrangement of the cord allows the positioning of the snap hook at its extremity at three different heights according to the heights and the distances between the three pulleys located in the lower portion of the device.

According to a particularly advantageous aspect of the present invention, the four moveable spindle catches are joined in pairs by means of a funicular element that encircles each or, respectively, one of the two pulleys located in the upper portion of the shed-forming device. Thus, the two pulleys located in the upper portion of the shed-forming device are vertically displaced according to the position of the moveable spindle catches to which they are attached by the funicular element; the position of these upper pulleys effects the position of the three lower pulleys and thus on the positioning of the snap hook at the extremity of the cord.

According to another advantageous aspect of the present invention, each shed-forming device comprises two selection mechanisms suitable to immobilize the two moveable spindle catches of one pair or only one of the moveable spindle catches in the proximity of the top dead position of their trajectory. Thus, this aspect of the present invention allows the controlling of the positioning of the four moveable spindle catches belonging to a shed-forming device by means of two selection mechanisms, that can be controlled by only one electromagnet, which contributes to the simplification of the weaving mechanism of the invention compared to that of the heretofore known state of the art, and allows an increase in its economic results.

Lastly, the present invention relates to a Jacquard-type loom provided with a weaving mechanism such as described above.

BRIEF DESCRIPTION OF THE DRAWINGS

The invention will be better understood and some of its other advantages will be more clearly elucidated in light of the below description of an embodiment of a weaving mechanism suitable to create three positions of the warp thread of a Jacquard-type loom, given solely by way of example and referenced in the hereto attached drawings wherein.

DESCRIPTION OF THE PREFERRED EMBODIMENT

Figures 1, 2, 3:
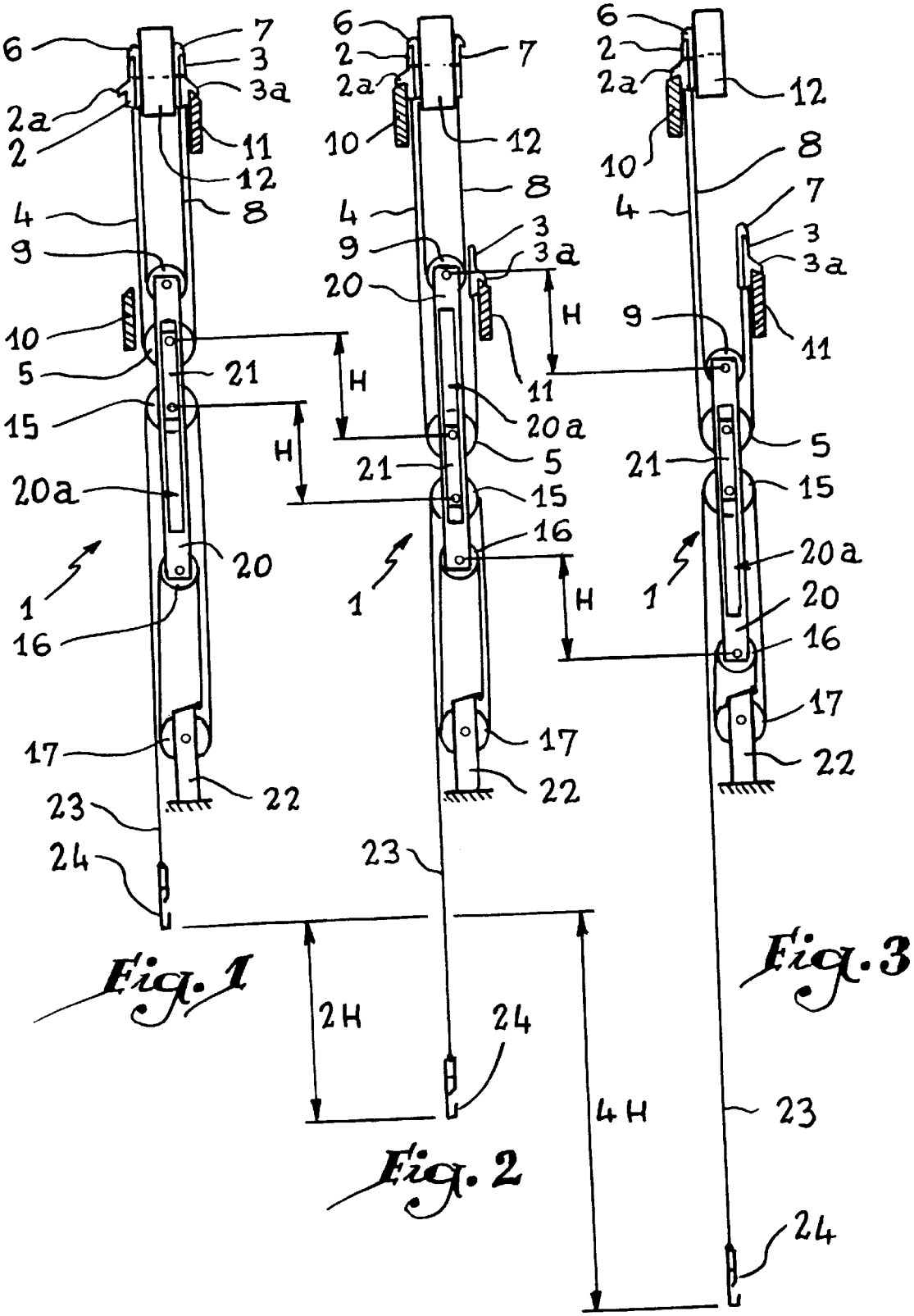
FIG. 1 is a side elevational view showing in a schematic form the elements of a shed-forming device pertaining to a weaving mechanism in accordance with the invention where the snap hook at the extremity of the cord is in its upper position.
FIG. 2 is a side elevational view analogous to that of FIG. 1 where the snap hook at the extremity of the cord is in its intermediate position.
FIG. 3 is a side elevational view analogous to that of FIG. 1, where the snap hook at the extremity of the cord is in its lower position, and FIG. 4 a partial side elevational view on an enlarged scale of two moveable spindle catches in the proximity of the top dead center position of their trajectory.

The shed-forming device 1 shown in FIG. 1 comprises two moveable lower spindle catches 2 and 3 linked by a cable 4 constituting a funicular element encircling a pulley 5. Two moveable upper spindle catches 6 and 7 are linked by a second cable 8 that partially encircles a second pulley 9. Cords can also be used instead of the cables 4 and 8. Two hasps or knives 10 and 11 driven in opposite reciprocally oscillating movements with respect to one another can selectively displace the moveable spindle catches 2 and 3 by engaging the locking levers 2*a* and 3*a* of the catches 2 and 3.

Pursuant to the present invention, the moveable spindle catches 6 and 7 are respectively supported on the moveable spindle catches 2 and 3, so that the moveable spindle catches 2 and 6 may be displaced together by the knife 11. Thus, the moveable spindle catches 2 and 6 constitute a first pair of moveable spindle catches while the moveable spindle catches 3 and 7 constitute a second pair of moveable spindle catches. A selection device 12 comprising, by way of example, an electromagnet, is suitable to immobilize the moveable spindle catches 2, 3, 6 or 7 in the proximity of the top dead center position of the trajectory they attain supported on the hasps 10 and 11. It can be noted that only one device 12 is used for the selection of the four aforementioned moveable spindle catches.

As it can be seen by comparing the FIGS. 1 to 3, according to the respective positions of the moveable spindle catches 2, 3, 6 and 7, the height of the pulleys 5 and 9 located in the upper portion of the device 1 is variable. The device 1 comprises another three pulleys 15, 16 and 17, located in its lower portion. The pulleys 5, 9, 15, 16 and 17 are vertically aligned and can be separated from each other in a variable manner depending on the positions of the four moveable spindle catches 2, 3, 6 and 7.

Advantageously, the pulleys 5, 9, 15, 16 and 17 are co-planar, which makes it possible to limit the lateral space the assembly they form and to simplify the construction of the mechanism.

A guide rail 20 keeps some pulleys aligned with each other. The rail 20 is provided with an oblong bore or slot 20*a* in which can be displaced a guide rod 21. The pulleys 5 and 15 are mounted on the guide rod 21 in such a manner that they can freely rotate and are stationary with respect to this guide rod. The pulleys 9 and 16 are respectively mounted at the upper and lower extremities of the rail 20 in such a manner that they can freely rotate and are stationary with respect to the rail 20. Thus, the rail 20 is supported by the upper pulley 9 and upwardly moveable therewith. In other respects, the pulley 17 is affixed to a base 22 integral with the frame of the mechanism. A cord 23 is attached at one of its extremities to the base 22 and successively encircles the pulley 16, the pulley 17 and then the pulley 15, and hangs below the pulley 15. The second extremity of the cord 23 is provided with a snap hook 24 that allows the suspending of one or several not represented heddle(s), controlling the position of one or several warp threads.

The manner of operation is as follows:

By starting from the position shown in FIG. 1, when the hasp 11 is driven downward by a vertical movement, if the moveable spindle catch 7 is kept in position in the proximity of the selection device 12 and if the moveable spindle catch 3 is released so that it travels downwards with the hasp 11, the pulley 9 rests in its position while the pulley 5 descends until reaching the position of FIG. 2. In this case, the pulley 15, of which the separation is fixed with respect to pulley 5, descends from a height H equal to that of the course of pulley 5 and the length of the cord 23 which successively encircles the pulleys 16, 17 and 15 is thus shorter, so that the length of the cord 23 that hangs on the other side of pulley 15 is longer than shown in the situation of FIG. 1, and the snap hook 24 descends from a height equal or double the height H corresponding to the course of the pulley 5. The snap hook 24 has thus reached the intermediary position shown in FIG. 2 moving a distance of 2 H.

By starting from the position shown in FIG. 1, if the selection device 12 does neither retain the moveable spindle catch 3 nor the moveable spindle catch 7, the pulleys 5 and 9 effectuate a downward translation movement from a height H, so that the pulley 16 descends from a height H while pulley 15 does also descend from a height H. Thus, the length of the cord 23 successively encircling pulleys 16, 17 and 15 is shortened 2H+2H, that is to say, four times the height H and the snap hook 24 hanging from the extremity of the cord 23 descends from an equivalent height, that is to say, 4H, in order to reach the lower position shown in FIG. 3.

Thus, the device, according to the present invention, allows to obtain the three positions of the snap hook, represented in FIGS., 1, 2, and 3, respectively, whereas the device occupies less space than heretofore. As a matter of fact, the positioning of the co-planar pulleys, one above the other, and the grouping in pairs of the moveable spindle catches give the shed-forming device a compactness that allows the designing of a weaving mechanism comprising a large number of cords, such as 10,000, and even more, with only one machine. This simplifies to a great extent the installation, the putting into service and the maintenance of a loom that incorporates such a mechanism.

Figure 4:
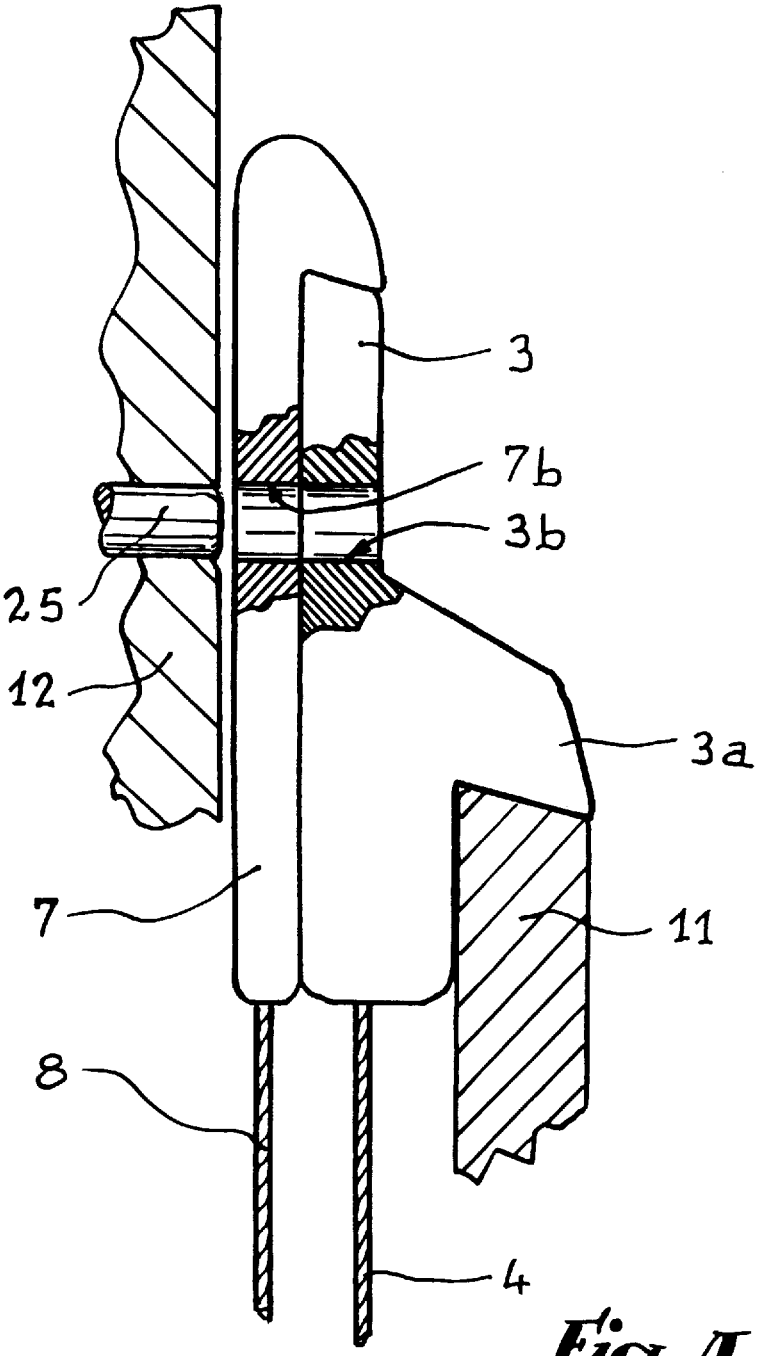

In FIG. 4, the moveable spindle catches 3 and 7 are shown in the proximity of their top dead center position, resting on the hasp or knife 11. In this position, they are located in the proximity of the selection device 12 that comprises a catch or retention member 25 forming the selection mechanism and appropriate to penetrate into two orifices 7*b* and 3*b* of the moveable spindle catches 7 and 3 by moving in a roughly perpendiculiar direction to the trajectory of the hasp 10. The moveable spindle catches 3 and 7 are designed in such a manner that, when the moveable spindle catch 7 is resting on the moveable spindle catch 3, the orifices 3*b* and 7*b* are aligned. The orifice 7*b* is opened and, according to its displacement towards the right in FIG. 4, the catch 25 penetrates either into only the orifice 7*b* or simultaneously into the orifices 7*b* and 3*b*. Thus, the catch 25 immobilizes either only the moveable spindle catch 7 or simultaneously the moveable spindle catches 7 and 3 in the proximity of the top dead center position of the trajectory.

If only the moveable spindle catch 7 is locked in its top position, the moveable spindle catch 3 follows the hasp 11 when it descends and the device reaches an intermediary position that is analogous to the one illustrated in FIG. 2. On the other hand, when none of the moveable spindle catches is immobilized, that is to say, when the catch 25 is in a retracted position inside the device 12, the moveable spindle catches 3 and 7 have a descending movement supported on the hasp 11, and the device reaches a position that is analogous to the one shown in FIG. 3.

Lastly, if the catch 25 simultaneously penetrates into the orifices 7*b* and 3*b*, the moveable spindle catches 3 and 7 are immobilized in the proximity of the device 12 and the device 1 rests in the position shown in FIG. 1, while the hasp 11 commences its downwards course.

The catch 25 is controlled by any suitable means and, by way of example, by an electromagnet.

In FIG. 4 it can be observed that the moveable spindle catch 7 is designed in such a manner as to take the outside shape of the moveable spindle catch 3, in such a manner that it is supported at the time of its displacements on the second moveable spindle catch.

The embodiment illustrated in FIG. 4 is not at all limiting and any selection device capable of immobilizing either one or the two moveable spindle catches of one pair may be used with the invention and, in particular, a device comprising locking levers, controlled by one or several electromagnets, or any other appropriate means.

A Jacquard-type loom provided with a weaving mechanism according to the present invention is more compact, easier to install and to maintain than the heretofore known looms intended to produce velvet or carpeting.

What I claim is:

1. A shed-forming device for a weaving mechanism for creating three positions of warp threads in a Jacquard-type loom and wherein the weaving mechanism includes knives which are moveable in opposite reciprocally oscillating motion, the shed-forming device comprising; four moveable spindle catches adapted for being displaced in pairs by the knives, a first spindle catch of each pair being adapted to be supported by a second spindle catch of each pair, and five pulleys vertically aligned in such a manner that they can be separated from each other in a variable manner depending on relative positions of said four spindle catches.

2. A shed-forming device in accordance with claim 1, wherein said five pulleys are co-planar.

3. A shed-forming device in accordance with claim 1, wherein each shed-forming device includes at least one guide rail extending between a plurality of said pulleys, said at least one guide rail being supported by one of said plurality of pulleys so as to be vertically moveable with said one of said plurality of pulleys.

4. A shed-forming device in accordance with claim 3, wherein said at least one guide rail is provided with a slot in which is displaced a guide rod on which are mounted two of said plurality of pulleys.

5. A shed-forming device in accordance with claim 1, wherein a funicular element is adapted to be attached at one of its extremities to a frame of the weaving mechanism and is provided at its opposite end with a snap hook adapted to be fastened to a heddle, and said funicular element partially encircling three of said pulleys located in a lower portion of said shed-forming device.

6. A shed-forming device in accordance with claim 5, wherein said funicular element starting from said one extremity adapted to be attached to the frame partially encircles a first vertically moveable pulley, then extends partially about a second pulley which is adapted to be stationary with respect to the frame and which is located vertically below said first pulley, and then extends partially about a third vertically moveable pulley, to said opposite end thereof.

7. A shed-forming device in accordance with claim 1, wherein said first spindle catches of each pair are linked by a first funicular element which partially encircles one of two pulleys located in an upper portion of said shed-forming device and said second spindle catches of each pair are linked by a second funicular element which partially encircles a second of said two pulleys located in said upper portion of said shed-forming device.

8. A shed-forming device in accordance with claim 1, including two selection mechanisms to selectively immobilize at least one of said first and second spindle catches of said each of said pairs of moveable spindle catches in proximity of a top dead center position.

9. A shed-forming device in accordance with claim 8, wherein each of said first and second moveable spindle catches is provided with an orifice for receiving a retention element of one of said selection mechanisms, said orifices of said first and second spindle catches being aligned when said first spindle catch of each pair is supported on said second spindle catch of each pair so that one of said retention elements can penetrate into one of said orifices or simultaneously into both orifices.

10. A shed-forming device in accordance with claim 1, wherein said first spindle catch of each pair of said moveable spindle catches is configured to cooperatively seat a portion of said second spindle catch of each pair, said second spindle catches being provided with a locking lever which is adapted to be engaged by one of the knives for moving said first and second spindle catches.

11. A Jacquard loom comprising, a weaving mechanism for creating three positions of warp threads and a series of shed-forming devices, each shed-forming device including four moveable spindle catches adapted for being displaced in pairs by knives which are moveable in oppositely reciprocally oscillating motion with respect to one another, a first spindle catch of each pair being adapted to be supported by a second spindle catch of each pair, and each shed-forming device including five pulleys vertically aligned in such a manner that they can be separated from each other in a variable manner depending on relative positions of said four spindle catches.

* * * * *